US010028527B2

(12) United States Patent
Jordan

(10) Patent No.: US 10,028,527 B2
(45) Date of Patent: Jul. 24, 2018

(54) PORTABLE MULTIFUNCTIONAL SMOKING UTENSIL HOLDER AND KIT

(71) Applicant: Scott Jordan, Ketchum, ID (US)

(72) Inventor: Scott Jordan, Ketchum, ID (US)

( * ) Notice: Subject to any disclaimer, the term of this patent is extended or adjusted under 35 U.S.C. 154(b) by 550 days.

(21) Appl. No.: 14/820,053

(22) Filed: Aug. 6, 2015

(65) Prior Publication Data

US 2017/0035105 A1 Feb. 9, 2017

(51) Int. Cl.

| | |
|---|---|
| ***A24F 15/00*** | (2006.01) |
| ***B65D 85/10*** | (2006.01) |
| ***B65D 85/12*** | (2006.01) |
| ***A24F 9/16*** | (2006.01) |
| ***A24F 9/08*** | (2006.01) |
| ***A24F 7/04*** | (2006.01) |

(52) U.S. Cl.

CPC ..... *A24F 9/16* (2013.01); *A24F 7/04* (2013.01); *A24F 9/08* (2013.01)

(58) Field of Classification Search

CPC .... A24F 9/16; A24F 9/08; A24F 23/00; A24F 7/04; A24F 17/00; B65D 85/10; B65D 85/12

USPC ..... 206/242–276, 86

See application file for complete search history.

(56) References Cited

U.S. PATENT DOCUMENTS

| | | | | |
|---|---|---|---|---|
| 2,228,381 | A * | 1/1941 | Adleman | A24F 1/00 131/183 |
| 2,467,923 | A * | 4/1949 | Allen | A24F 15/12 206/236 |
| 5,605,226 | A * | 2/1997 | Hernlein | A24F 15/18 206/496 |
| 2009/0250360 | A1* | 10/2009 | Bellamah | A24F 23/00 206/247 |
| 2012/0097774 | A1* | 4/2012 | Hainbach | A47J 42/14 241/101.2 |
| 2013/0025608 | A1* | 1/2013 | Fakhouri | A24F 9/00 131/311 |

* cited by examiner

*Primary Examiner* — Rafael Ortiz

(74) *Attorney, Agent, or Firm* — Andrew F. Young, Esq.; Lackenbach Siegel, LLP

(57) ABSTRACT

A portable multifunctional smoking utensil holder and kit is disclosed that may include a holder for smoking utensils that includes a lower portion; and an upper portion that is pivotably attached to the lower portion, wherein the lower portion includes a first compartment that is configured to slidably and removably receive a pipe therein for storing the pipe; a second compartment that is configured to store a leafy substance therein; and a third compartment that is open to the second compartment, the third compartment including a first portion and a second portion, the first portion configured to slidably receive the pipe therein, the second portion including a grinding mechanism that is configured to transfer and grind substances from the second compartment into the third compartment when the grinding mechanism is actuated.

11 Claims, 7 Drawing Sheets

PORTABLE MULTIFUNCTIONAL SMOKING UTENSIL HOLDER AND KIT

BACKGROUND

Field of the Disclosure

The present disclosure generally relates to paraphernalia and utensils for facilitating smoking, and more particularly to a portable smoking utensil holder and a kit including the holder and utensils that facilitate a variety of functions related to storing and using smoking utensils.

Description of the Related Art

Preparing a homemade cigarette that includes tobacco or another leafy combustible substance (e.g., legal medical marijuana) is typically something that cannot be done when on the move. For example, loose leaves, rolling paper, lighters, etc. are cumbersome and not easily transported in a smoker's pocket.

As a result, smokers typically buy ready-made cigarettes or prepare cigarettes or the like prior to traveling. It would be advantageous if there existed portable devices that would facilitate smoking homemade cigarettes without requiring a lot of preparation.

Consequently, there is a continuing need for portable equipment that would facilitate smoking.

SUMMARY

Disclosed herein is a holder for smoking utensils, which may include a lower portion; and an upper portion that is pivotably attached to the lower portion. The lower portion may include a first compartment that is configured to slidably and removably receive a pipe therein for storing the pipe; a second compartment that is configured to store a leafy substance therein; and a third compartment that is open to the second compartment. The third compartment may include a first portion and a second portion, and the first portion may be configured to slidably receive the pipe therein. The second portion may include a grinding mechanism that is configured to transfer and grind substances from the second compartment into the third compartment when the grinding mechanism is actuated. The grinding mechanism may be rotatable about an axis extending lengthwise through the third compartment, and rotation of the grinding mechanism may be configured to cause substances within the second compartment to be ground and transferred to the first portion of the third compartment. The second compartment may be configured to receive a lighter therein. One or more apertures for receiving picks may be formed in the lower portion.

A biasing member (e.g., a spring) may bias the upper and lower portions toward one another or away from one another such that the upper portion is spring-loaded. A locking mechanism (e.g., a latch) may maintain the upper and lower portions in a closed position relative to one another, and upon release of the locking mechanism, the upper portion may automatically pivot toward an open position relative to the lower member. At least one of the upper and lower portions may include a mirrored portion.

The pipe may include one or more segments that are separable from one another to facilitate cleaning. Moreover, the pipe may include a filter element. One or more of the segments of the pipe may include a filter. A magnet may releasably couple the pipe to an aperture within the lower portion for convenient and secure storage of the pipe within the aperture such that a sufficient and predetermined force is needed to decouple the pipe from the aperture in which it is placed. Alternatively or additionally, the pipe may frictionally engage the aperture such that a sufficient and predetermined force is needed to slide the pipe out from the aperture in which it is placed.

The second compartment may include a funnel that is configured to facilitate loading the leafy substance within the second compartment. The funnel may be transitionable between a stored condition in which it is fully placed within the second compartment and a deployed condition in which it is partially placed outside of the second compartment. An interior of the second compartment is viewable from an exterior of the holder, thereby providing an indicator window through which the amount of product contained within the second compartment is readily ascertainable.

A kit for smoking may include the holder for smoking utensils described above, and may further include a pipe that is configured to be received within the first compartment, and a lighter that is configured to be removably coupled and received within the second compartment. The lower portion may includes one or more apertures for receiving picks formed in the lower portion, and the kit may further include one or more picks that are configured to be received in respective ones of the one or more apertures for receiving picks.

Tactile sensations and sounds may be provided during the operation of the holder and kit. For example, opening and closing the upper and lower portions relative to one another may provide a clicking sound or the like. Similarly, removal of the pipe may also provide a clicking sound or the like. Such sounds may provide an audible confirmation, for example, that the upper portion is in an open position relative to the lower portion or that the upper and lower portions are in a closed position. Advantageously, this may reduce the likelihood that a user may, for example accidentally place the holder within the user's pocket when the upper and lower portions are in an open position relative to one another.

The above and other aspects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
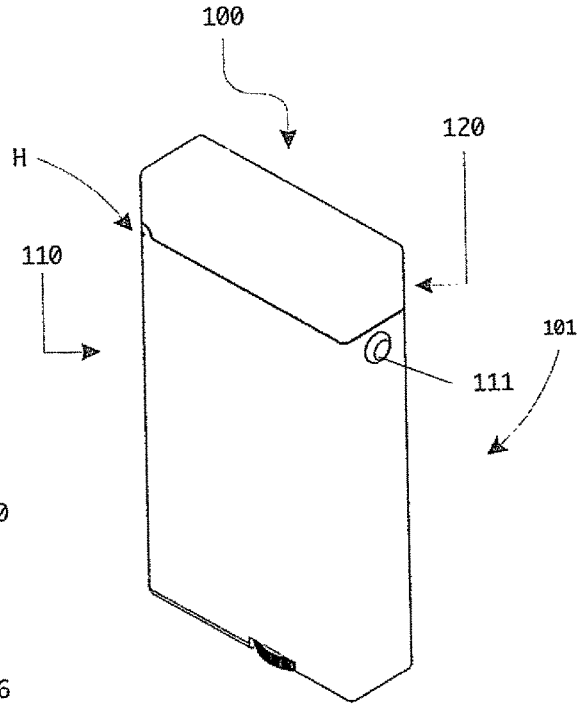
FIG. 1 is a perspective view of a smoking device in accordance with the present disclosure shown in a closed condition.

Reference will now be made in detail to embodiments of the disclosure. Wherever possible, same or similar reference numerals are used in the drawings and the description to refer to the same or like parts or steps. The drawings are in simplified form and are not to precise scale. The word 'couple' and similar terms do not necessarily denote direct and immediate connections, but also include connections through intermediate elements or devices. For purposes of convenience and clarity only, directional (up/down, etc.) or motional (forward/back, etc.) terms may be used with respect to the drawings. These and similar directional terms should not be construed to limit the scope in any manner. It will also be understood that other embodiments may be utilized without departing from the scope of the present invention, and that the detailed description is not to be taken in a limiting sense, and that elements may be differently positioned, or otherwise noted as in the appended claims without requirements of the written description being required thereto. The term 'proximal' refers to a side or end that would be close to the user during use and the term 'distal' refers to a side or end that would be farther from the user during use.

Various operations may be described as multiple discrete operations in turn, in a manner that may be helpful in understanding embodiments of the present invention; however, the order of description should not be construed to imply that these operations are order dependent.

Various embodiments of a smoking device are described herein with reference to FIGS. 1-11.

One embodiment of a smoking device will now be described with reference to FIGS. 1-5.

Figure 2:
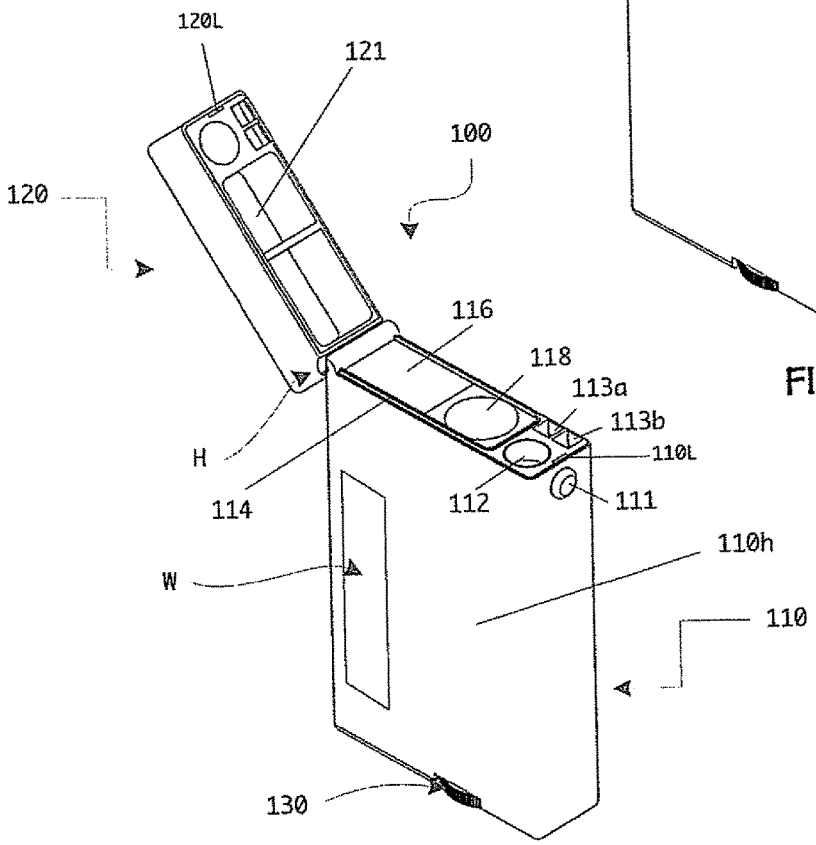
FIG. 2 is a perspective view of the smoking device of FIG. 1 shown in an open condition.
Figure 3:
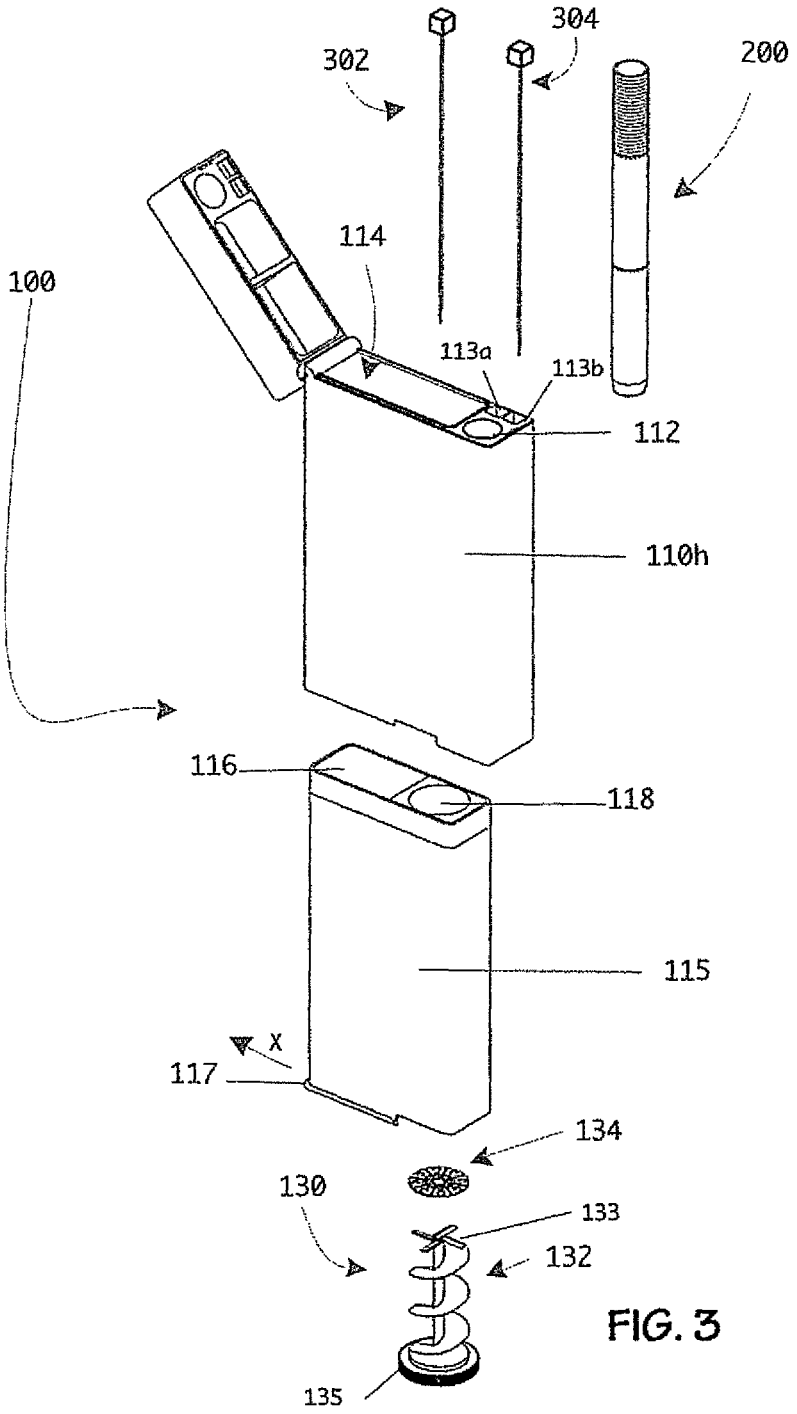
FIG. 3 is an exploded view of the smoking device of FIG. 1 shown with a variety of utensils.
Figure 4:
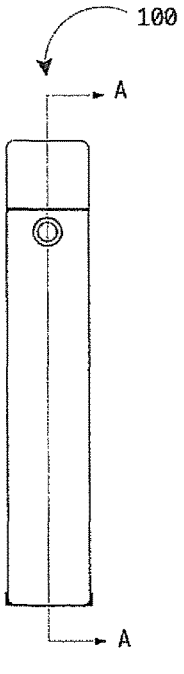
FIG. 4 is a side view of the smoking device of FIG. 1.
Figure 5:
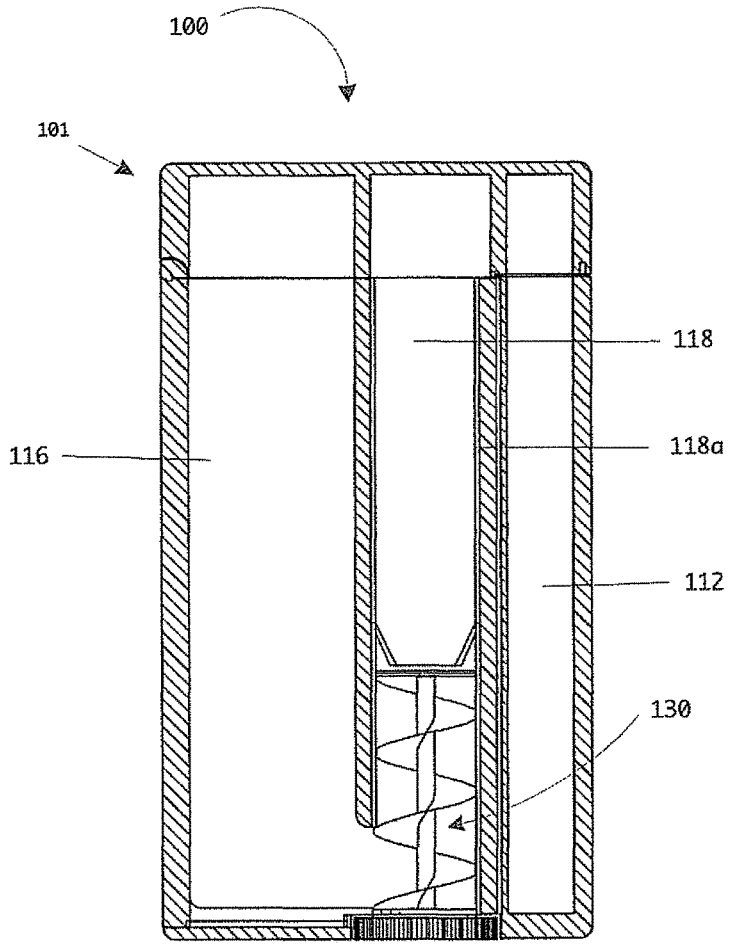
FIG. 5 is a partial cross-sectional, see-through view of the smoking device of FIG. 1 taken along sectional line A-A, and shown with a grinding mechanism.
Figure 6:
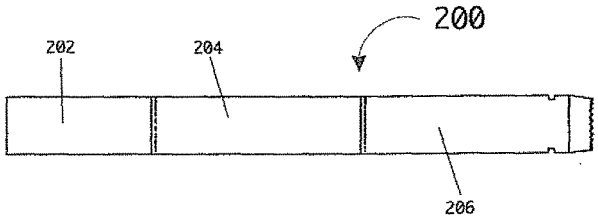
FIG. 6 is a front view of a pipe.

Smoking device 100 may include a smoking utensil holder 101, lower portion 110, and an upper portion 120, which may include a mirror 121 on a surface thereof. In particular, as shown in FIG. 2, the mirror 121 may be disposed on an inner surface of the upper portion 120. The lower portion 110 and the upper portion 120 may be pivotably connected to each other via a hinge 11. Mating locking parts 110L on the lower portion 110 and 120L on the upper portion may engage one another to maintain the lower and upper portions 110, 120 in a locked configuration, and may be opened by depressing a button 111 that releases the locking parts 110L, 120L. The lower portion 110 includes an outer housing 110*h* that may include a generally cylindrical aperture 112 which may be configured to receive a pipe 200 along its length.

The outer housing 110*h* may also include one or more cylindrical apertures 113*a*, 113*b* that may each receive a pick 302, 304 (FIG. 8) that are configured to facilitate cleaning of the pipe 200. Windows (not shown) may be formed in the outer housing 110*h*, near a proximal end of the outer housing 110*h*, to facilitate removal of the picks 302, 304 therefrom. Any or all of the picks 302, 304 and pipe 200 may be releasably secured within respective apertures 113*a*, 113*b*, 112 via a magnetic or friction fit connection. Alternatively, the picks 302, 304 and pipe 200 may be releasably secured via a spring fit.

The outer housing 110*h* may include a compartment 114 that is configured to receive therein an inner housing 115 that includes a compartment 116 in which a leafy, combustible material or substances (e.g., tobacco or the like) may be placed. A door 117 may provide access to the compartment 116 for inserting, removing, or cleaning substances from the compartment 116. The door 117 may be slidable along or against directional arrow X to open or close the compartment 116, respectively. The inner housing 115 may also include a cylindrical aperture 118 which may include a grinding mechanism 130 that may include a screw 132 that is configured to direct substances from the compartment 116 in an upward direction, a cutter 133 that is configured to cut or grind the substance, and a filter/cutter 134 that is configured to allow particles of a particle size into the proximal area of the cylindrical aperture 118, and a rotatable wheel 135. The grinding mechanism 130 may be removed and replaced with another grinding mechanism 130 that is substantially the same but that is configured to grind product (e.g., leafy substance such as tobacco or the like) into a different coarseness (e.g., more fine or less fine).

An indicator window W including an aperture formed in the outer housing 110*h* and a clear or transparent material (e.g., glass or plastic) which is fitted within the aperture may facilitate viewing the inner housing 115. The inner housing 115 may be formed at least partially from a clear or transparent material such that product contained within the compartment 116 is viewable via the window W to provide an indication of how much product is contained therein.

Figure 7:
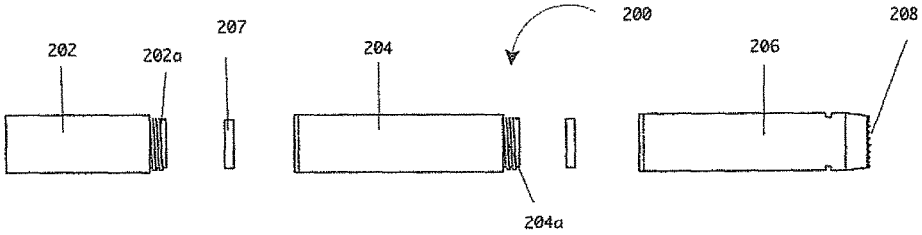
FIG. 7 is an exploded view of the pipe of FIG. 6 shown with parts separated.

As shown in FIG. 7, to facilitate cleaning of the pipe 200, the pipe 200 may be formed from a plurality of interlockable or connectable tubes 202, 204, 206, which may be releasably locked together via a screw threading 202*a*, 204*a*, which are configured to engage corresponding threading (not shown) of adjacent tubes 204, 206, respectively. Washers 207 may be fitted between adjacent ones of the tubes 202, 204, 206. One or more of the tubes 202, 204, 206 may include a filter (e.g., element 208 may serve as a filter), which may be removable and disposed within respective ones of the tubes 202, 204, 206. The element 208, which is secured at an end of the tube 206, may be configured to include a sharp, coarse or rough surface such that it may function as a minder to cut or break up product, e.g., a leafy substance such as tobacco or the like. The most proximal tube 202 may be fitted with a filter. The filter(s) may be a metal mesh-like material or may be formed from any suitable fibrous material that is configured to filter out fine particles in the smoke, and may be removable and/or replaceable after use.

Figure 8:
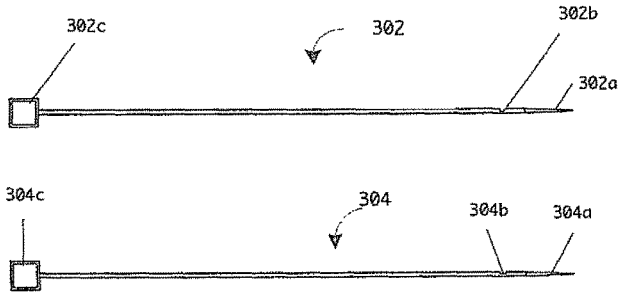
FIG. 8 is a front view of picks in accordance with the present disclosure.

As shown in FIG. 8, the picks 302, 304, which may have different lengths and/or thicknesses, may have a generally tapered distal end 302*a*, 304, respectively, that may be used to clean ashes and the like from the pipe 200. A latch 302*b*, 304*b* may serve to releasably secure the picks 302, 304, respectively, within a corresponding locking structure (not shown) within the apertures 113*a*, 113*b*. The ends 302*c*, 304*c* of respective ones of the picks 302, 304 may be magnetically attracted to the apertures 113*a*, 113*b* within which they are placed or may instead or additionally be frictionally secured within the respective apertures 113*a*, 113*b*. A spring (not shown) may be within respective ones of the apertures 113*a*, 113*b* such that when pushing the picks 302, 304 further into the apertures 113*a*, 113*b* the latches 302*b*, 304*b* decouple from the respective latching structures within the apertures 113*a*, 113*b*, whereupon the spring would push the picks 302, 304 outward from their respective apertures 113*a*, 113*b*.

During operation, the smoking device 100 may have audio effects corresponding with the particular action being performed. For example, when rotating the wheel 135 of the grinding mechanism 130, there may be a corresponding clicking sound. Also, for example, when opening the upper portion 120 relative to the lower portion 110, there may be a pleasing opening sound, which may be caused by actuating a biasing mechanism (e.g., a spring) (not shown), which may be operatively coupled to the hinge H pivotably connecting the upper and lower portions 120, 110.

Figure 9:
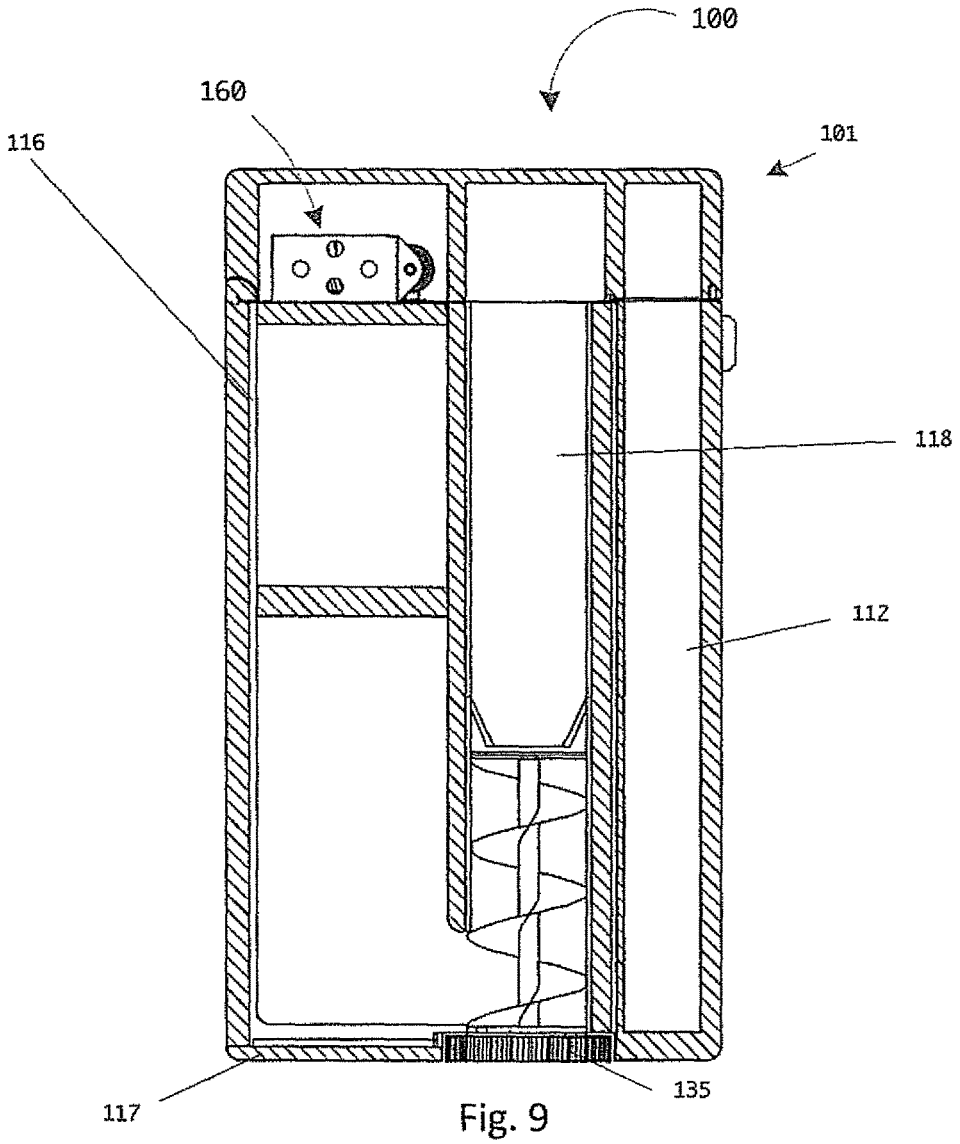
FIG. 9 is a partial cross-sectional, see-through view of the smoking device of FIG. 1 taken along sectional line A-A, and shown with a grinding mechanism and a lighter.
Figure 10:
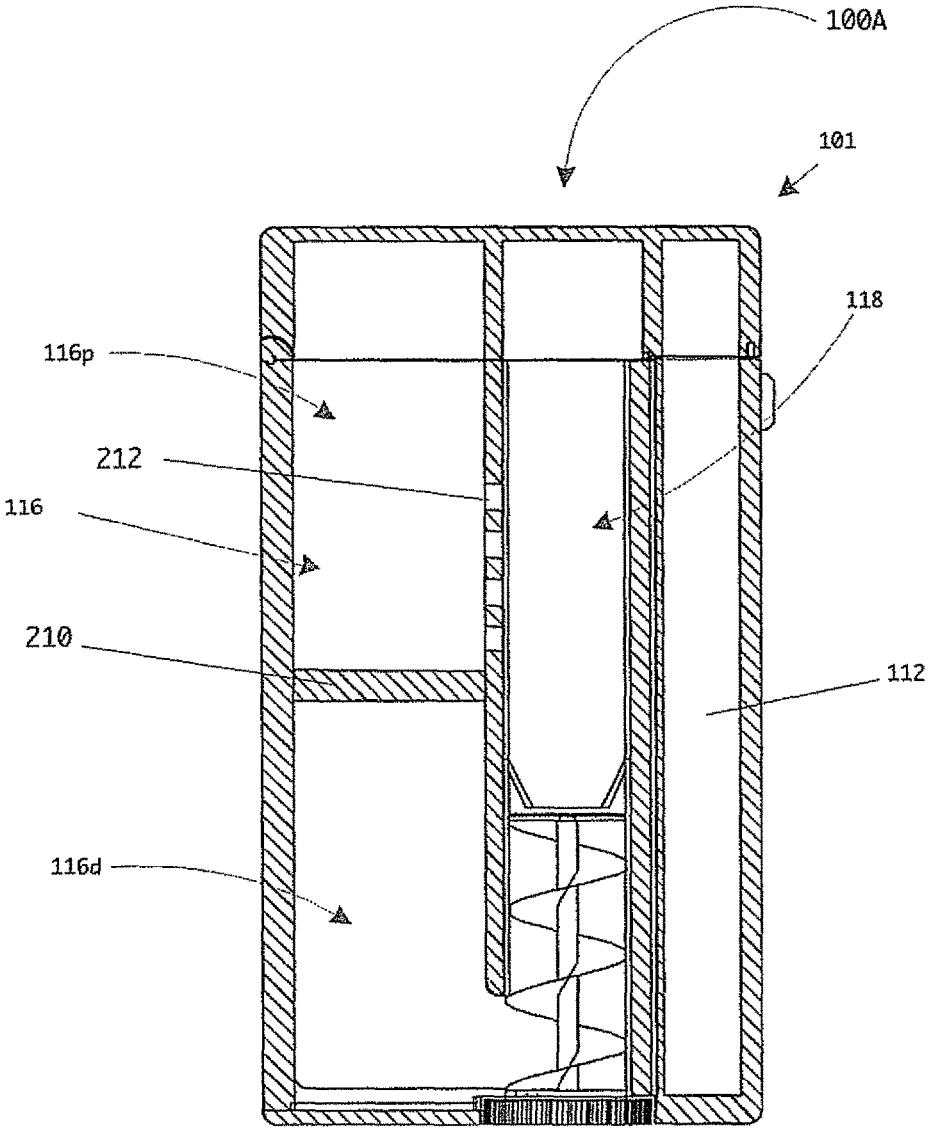
FIG. 10 is a partial cross-sectional, see-through view of the smoking device in accordance with another embodiment of the present disclosure.

A smoking kit may include various implements or utensils (e.g., picks 302, 304, pipe 200) that are stored within the utensil holder 101. Further, as shown in FIG. 9, a lighter 160 may be removably or permanently press-fit into a proximal end of the compartment 116. With the lighter 160 placed within the compartment 116, access to the compartment 116 may still be gained via the door 117.

In another embodiment, a smoking device 100A that is substantially similar to the smoking device 100 may include a dividing wall 210 that separates the compartment into an upper or proximal compartment and a lower or distal compartment 116*p*, 116*d*, respectively, such that two different substances may be stored within the compartments 116*p*, 116*d* without being mixed. A plurality if apertures 212 may extend between a wall that divides the cylindrical apertures 116, 118 to facilitate insertion of the pipe 200 through the aperture 118, for example, by reducing the likelihood that air pressure from the piston-like action of the insertion of the pipe into the aperture 118 would inhibit such insertion.

During use, a leafy substance (e.g., tobacco, legal medical marijuana or the like) may be stored within the compartment 116. The rotatable wheel 135 may be turned, which causes the screw 132 to upwardly translate the substance from the compartment up towards the cutter 133 and through the filter 134. The pipe 200 may then be removed from the cylindrical aperture 112 and inserted into the cylindrical aperture 118 to jam or pack the grounded substance into the pipe 200. As more substance is desired to be loaded into the pipe 200, the wheel 135 may be rotated directing more ground substance into the aperture 118 where the pipe 200 loads the ground substance by pressing the pipe 200 into the aperture 118. Thereafter, the substance may be heated or set afire by using the provided lighter 160. After use, the pipe 200 may be cleaned using the provided picks 302, 304 and/or may be disassembled. After use, the pipe 200 may once again be stored within the aperture 112.

Figure 11:
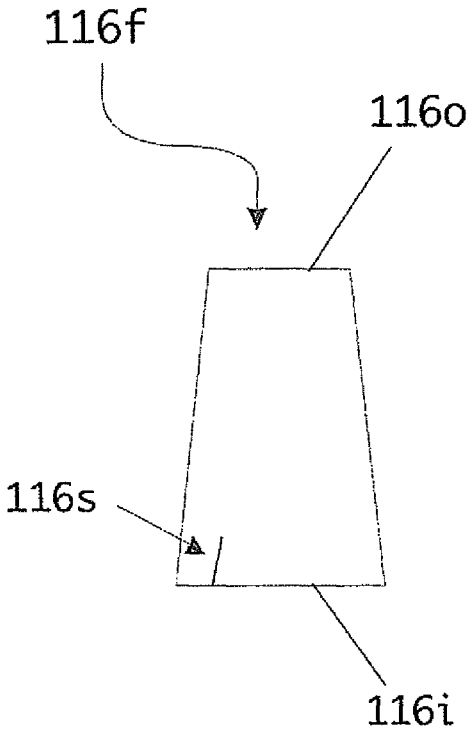
FIG. 11 is a front view of a funnel in accordance with an embodiment of the present disclosure.

Loading of product (e.g., a leafy substance such as tobacco, legal medical marijuana, or the like) within the compartment 116 may be facilitated via a funnel 116*f*, as shown in FIG. 11, which has a tapered shape in an inlet end 116*i* is wider than an outlet end 116*o*. The funnel 116*f* may be removably or fixedly placed within the compartment via a force-fit or interference fit relationship. The funnel 116*f* may be formed from a compressible material having shape memory properties (e.g., a rubber or a polymer). The outlet end 116*o* of the funnel 116 may be placed deeper within the compartment 116 than its inlet end 116*i*, and the funnel 116 may be placed at or near the bottom of the compartment 116 that is covered by cover 117. When the cover 117 moved to open the compartment 116, the outlet end 116*o* of the funnel 116*f* may transition to an expanded condition out from the compartment 116, and when the cover 117 is moved to seal or close the compartment 116, the outlet end 1160 of the funnel 116*f* may be pushed inwardly into the interior of the compartment 116. Slits, seams, or areas of stress concentration 116*s* may be formed within the funnel 116*f* such that folding or pushing of the funnel 116*f* into the compartment 116 may be more easily achieved.

Having described at least one of the preferred embodiments of the present disclosure with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A holder for smoking utensils, comprising:

a lower portion; and an upper portion that is pivotably attached to the lower portion via a hinge, the upper and lower portions having a generally rectangular shape; and a locking mechanism that is configured to transition the lower portion and the upper portion between a closed configuration with respect to one another and an open configuration with respect to one another, a biasing member biasing the upper and lower portions away from one another when in the open configuration, the lower and upper portions comprising mating locking parts that releasably secure the upper and lower portions to one another when in the closed configuration, wherein the lower portion comprises:

a first compartment that is configured to slidably and removably receive a pipe therein for storing the pipe;

a second compartment that is configured to store a leafy substance therein; and a third compartment that is open to the second compartment, the third compartment including a first portion and a second portion, the first portion configured to slidably receive the pipe therein, the second portion including a grinding mechanism that is configured to transfer and grind substances from the second compartment into the third compartment when the grinding mechanism is actuated, the grinding mechanism further comprising:

a helical screw extending longitudinally along a first section of a length of the second portion, the first section being adjacent to a second section of the second portion, the second section having a tapered shape to direct substances contained therein toward the helical screw;

a rotatable wheel being operatively coupled to the helical screw to effect rotation of the helical screw when the rotatable wheel is rotated, the rotatable wheel being generally flush with respect to a lateral surface of lower portion; and a filter being disposed between the helical screw and the second section of the second portion.

2. The holder of claim 1, wherein the grinding mechanism is rotatable about an axis extending lengthwise through the third compartment, and wherein rotation of the grinding mechanism is configured to cause substances within the second compartment to be ground and transferred to the first portion of the third compartment.

3. The holder of claim 1, further comprising a lighter removably secured within the second compartment.

4. The holder of claim 1, wherein the lower portion further comprises one or more apertures for receiving picks along their lengths, wherein a latched connection between each respective aperture and each respective pick releasably secures the the pick within the aperture.

5. The holder of claim 1, further comprising an indicator window through which an interior of the second compartment is viewable from an exterior of the holder.

6. A kit for smoking, comprising:

a pick;

a holder for smoking utensils, the holder comprising:

a lower portion; and an upper portion that is pivotably attached to the lower portion via a hinge, the upper and lower portions having a generally rectangular shape; and a locking mechanism that is configured to transition the lower portion and the upper portion between a closed configuration with respect to one another and an open configuration with respect to one another, a biasing member biasing the upper and lower portions away from one another when in the open configuration, the lower and upper portions comprising mating locking parts that releasably secure the upper and lower portions to one another when in the closed configuration, wherein the lower portion comprises:

a first compartment that is configured to slidably and removably receive a pipe therein for storing the pipe;

a second compartment that is configured to store a leafy substance therein; and a third compartment that is open to the second compartment, the third compartment including a first portion and a second portion, the first portion configured to slidably receive the pipe therein, the second portion including a grinding mechanism that is configured to transfer and grind substances from the second compartment into the third compartment when the grinding mechanism is actuated, the grinding mechanism comprising:

a helical screw extending longitudinally along a first section of a length of the second portion, the first section being adjacent to a second section of the second portion, the second section having a tapered shape to direct substances contained therein toward the helical screw;

a rotatable wheel being operatively coupled to the helical screw to effect rotation of the helical screw when the rotatable wheel is rotated, the rotatable being generally flush with respect to a lateral surface of lower portion; and a filter being disposed between the helical screw and the second section of the second portion; and one or more apertures for receiving the pick along its length, wherein a latched connection between the aperture and the tool releasably secures the tool within the aperture; and a pipe that is configured to be received within the first compartment.

7. The kit of claim 6, further comprising:

a lighter that is configured to be received within the second compartment.

8. The kit of claim 6, wherein the one or more apertures is cylindrical.

9. The kit of claim 6, wherein the pipe includes a plurality of sections that are removably coupled to one another.

10. The kit of claim 9, wherein at least one of the sections of the pipe includes a removable filter.

11. The kit of claim 6, further comprising a mirror that is disposed on an inner surface of the upper portion.

* * * * *